US010526256B2

(12) United States Patent
Penny et al.

(10) Patent No.: US 10,526,256 B2
(45) Date of Patent: Jan. 7, 2020

(54) NON-PHTHALATE PROPELLANTS

(71) Applicant: BAE SYSTEMS plc, London (GB)

(72) Inventors: Mark James Penny, Monmouthshire (GB); Anne Marie Wilton, Renfrewshire Strathclyde (GB); Thomas William Delaney Somerville, Renfrewshire Strathclyde (GB)

(73) Assignee: BAE SYSTEMS plc, London (GB)

( * ) Notice: Subject to any disclaimer, the term of this patent is extended or adjusted under 35 U.S.C. 154(b) by 180 days.

(21) Appl. No.: 14/780,899

(22) PCT Filed: Mar. 18, 2014

(86) PCT No.: PCT/GB2014/050849
§ 371 (c)(1),
(2) Date: Sep. 28, 2015

(87) PCT Pub. No.: WO2014/155061
PCT Pub. Date: Oct. 2, 2014

(65) Prior Publication Data

US 2016/0052836 A1 Feb. 25, 2016

(30) Foreign Application Priority Data

Mar. 27, 2013 (EP) ..... 13275081
Mar. 27, 2013 (GB) ..... 1305590.0

(51) Int. Cl.
*C06B 25/30* (2006.01)
*C06B 25/34* (2006.01)
(Continued)

(52) U.S. Cl.
CPC ..... *C06B 25/34* (2013.01); *C06B 45/00* (2013.01); *C06B 45/10* (2013.01)

(58) Field of Classification Search
CPC ..... C06B 25/00; C06B 25/34; C06B 25/30; C06B 25/04; D03D 23/00; D03D 43/00
(Continued)

(56) References Cited

U.S. PATENT DOCUMENTS 3,953,259 A 4/1976 Sayles
4,092,188 A 5/1978 Cohen et al.
(Continued)

FOREIGN PATENT DOCUMENTS

DE 102010005923 A1 6/2011
EP 0495714 A1 7/1992
(Continued)

OTHER PUBLICATIONS

International Search Report and Written Opinion received for Patent Application No. PCT/GB2014/050848, dated Apr. 17, 2014. 10 pages.
(Continued)

*Primary Examiner* — James E McDonough
(74) *Attorney, Agent, or Firm* — Finch & Maloney PLLC

(57) ABSTRACT

The invention relates to Insensitive Munition (IM) energetic materials particularly non-phthalate IM propellant compositions.

An energetic composition suitable for use as a propellant comprises the following components in the following relative proportions:

component A; from 60% to 90% by weight of a highly energetic filler comprising at least one nitramine compound; and component B: from 5% to 20% by weight of a binder, component C: from and 3% to 15% of a plasticiser wherein the plasticiser comprises formula (A)

of from 1% to 9% by weight, wherein Formula (A) is a diester plasticiser of (Continued)

$R_1$—OC(O)—$R_3$—C(O)O—$R_2$, Formula (A)

wherein $R_1$, $R_2$, and $R_3$ are independently selected from $C_3$ to $C_{10}$ alkyl or alkenyl.

the percentages by weight of components A, B and C, together with minor additives, if any, adding to 100%.

16 Claims, 1 Drawing Sheet

(51) Int. Cl.

| | |
|---|---|
| ***C06B 45/10*** | (2006.01) |
| ***C06B 45/00*** | (2006.01) |
| *C06B 25/00* | (2006.01) |
| *C06B 25/04* | (2006.01) |
| *D03D 23/00* | (2006.01) |
| *D03D 43/00* | (2006.01) |

(58) Field of Classification Search
USPC ..... 149/2, 88, 92, 95, 105, 108.2
See application file for complete search history.

(56) References Cited

U.S. PATENT DOCUMENTS

| | | | | |
|---|---|---|---|---|
| 4,116,734 | A | 9/1978 | Perrault et al. | |
| 4,289,551 | A * | 9/1981 | Perrault | C06B 23/009 149/19.4 |
| 4,379,007 | A * | 4/1983 | Fifer | C06B 25/34 149/22 |
| 4,919,737 | A | 4/1990 | Biddle et al. | |
| 5,034,072 | A | 7/1991 | Becuwe | |
| 5,034,073 | A | 7/1991 | Barry et al. | |
| 5,500,060 | A * | 3/1996 | Holt | C06B 25/34 149/105 |
| 5,529,649 | A * | 6/1996 | Lund | C06B 25/34 149/105 |
| 6,228,190 | B1 | 5/2001 | Debenham | |
| 6,692,655 | B1 * | 2/2004 | Martins | C06B 21/0058 149/17 |
| 6,833,037 | B1 * | 12/2004 | Hallam | C06B 45/10 149/19.9 |
| 7,211,140 | B1 | 5/2007 | Mertz et al. | |
| 7,857,920 | B1 | 12/2010 | Mason | |
| 2001/0003295 | A1 * | 6/2001 | Langlotz | C06B 25/34 149/19.91 |
| 2002/0003016 | A1 * | 1/2002 | Ampleman | C06B 21/005 149/18 |
| 2005/0115652 | A1 | 6/2005 | Augier et al. | |
| 2011/0073224 | A1 * | 3/2011 | Heister | C06B 21/0025 149/18 |
| 2011/0284140 | A1 | 11/2011 | Muller et al. | |
| 2012/0138201 | A1 * | 6/2012 | Schaedeli | C06B 25/18 149/14 |
| 2013/0048163 | A1 * | 2/2013 | Hafner | C06B 25/24 149/6 |
| 2016/0046537 | A1 | 2/2016 | Penney et al. | |

FOREIGN PATENT DOCUMENTS

| | | | |
|---|---|---|---|
| FR | 2691963 | A1 | 12/1993 |
| GB | 964001 | | 7/1964 |
| GB | 1554636 | | 10/1979 |
| GB | 2264942 | A | 9/1993 |
| GB | 2265896 | A | 10/1993 |
| GB | 2371297 | A | 7/2002 |
| JP | 2008110892 | A | 5/2008 |
| WO | 3935108 | A1 | 7/1999 |
| WO | 2009131563 | A1 | 10/2009 |
| WO | 2010023450 | A1 | 3/2010 |
| WO | 2014155060 | A1 | 10/2014 |
| WO | 2014155061 | A1 | 10/2014 |

OTHER PUBLICATIONS

International Preliminary Report on Patentability received for Patent Application No. PCT/GB2014/050848, dated Oct. 8, 2015. 7 pages.

GB Intellectual Property Office Search Report under Section 17(5) received for GB Patent Application No. 1305589.2 dated Sep. 30, 2013. 4 pages.

Extended European Search Report received from EP Patent Application No. 13275082.9 dated Sep. 5, 2013. 7 pages.

International Preliminary Report on Patentability received for Patent Application No. PCT/GB2014/050849, dated Oct. 8, 2015. 8 pages.

International Search Report and Written Opinion received for Patent Application No. PCT/GB2014/050849, dated Apr. 17, 2014. 12 pages.

GB Intellectual Property Office Search Report under Section 17(5) received for GB Patent Application No. 1305590.0 dated Sep. 30, 2013. 3 pages.

Extended European Search Report received from EP Patent Application No. 13275081.1 dated Sep. 6, 2013. 8 pages.

Erythropel, et al., "Designing green plasticizers: Influence of molecular geometry on biodegradation and plasticization properties," Chemosphere, Feb. 2012. Elsevier Ltd GBR, vol. 86, No. 8. pp. 759-766.

Rahman, M. and Brazel, C.S., "The plasticizer market: An assessment of traditional plasticizers and research trends to meet new challenges," Progress in Polymer Science (Oxford), Dec. 2004. Elsevier Ltd GB, vol. 29, No. 12.pp. 1223-1248.

* cited by examiner

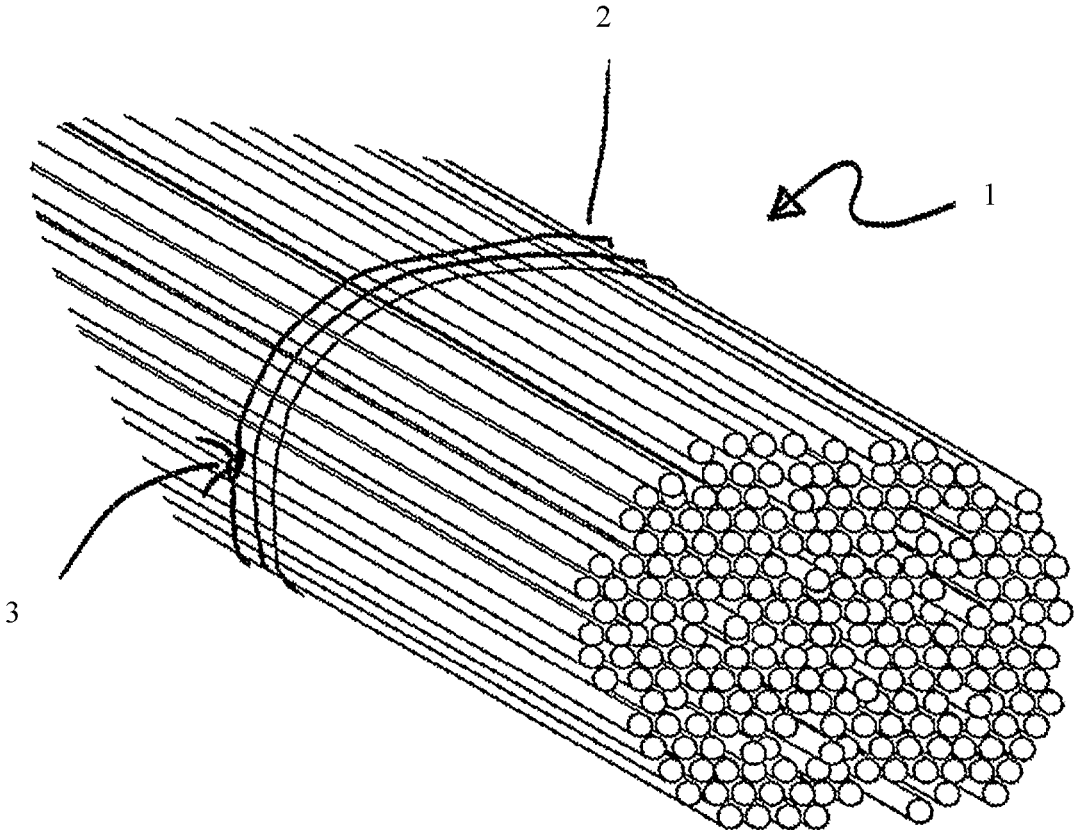
2
1
3

NON-PHTHALATE PROPELLANTS

The invention relates to Insensitive Munition (IM) energetic materials particularly non-phthalate IM propellant compositions.

Low and high energy gun propellants and their energetic compositions, are based on colloidal mixtures of nitroglycerine, nitrocellulose and nitroguanidine (also called picrite) in varying proportions, such as those discussed in GB2371297. The technology used to manufacture these has changed little in 100 years.

Colloidal compositions are, generally, classed as single, double, or, triple base compositions depending on the proportions of the major constituents present (i.e. one, two or three major components, respectively). Other components, e.g. nitramines, have been incorporated to increase the force constant, or, energy level, of these compositions and colloidal compositions comprising three, or, more major components, may be referred to as multibase compositions.

Colloidal propellants, particularly for high energy applications, suffer from the disadvantage that they are highly vulnerable to unwanted ignition when in a hostile environment and subjected to attack by an energetic projectile, e.g. a projectile comprising a shaped warhead charge.

According to a first aspect of the invention there is provided an energetic composition suitable for use as a propellant comprising the following components in the following relative proportions:

component A; from 60% to 90% by weight of a highly energetic filler comprising at least one nitramine compound; and component B: from 5% to 20% by weight of a binder component C: from 3% to 15% of a plasticiser wherein the plasticiser comprises formula (A) of from 1% to 12% by weight, wherein Formula (A) is a diester plasticiser of $$R_1—OC(O)—R_3—C(O)O—R_2, \qquad \text{Formula (A)}$$

wherein $R_1$, $R_2$, and $R_3$ are independently selected from $C_1$ to $C_{10}$ alkyl, alkenyl, the percentages by weight of components A, B and C, together with minor additives, if any, adding to 100%.

The use of phthalates in industrial processes are being phased out due to their toxic nature. Their use as plasticisers are well known and are compatible with many energetic compositions. It has been advantageously found that dialkyl esters, such as those defined by Formula (A), may be used to replace phthalates.

The role of a plasticiser has a two-fold effect. It is used as a processing aid to increase pliability of the dough like material, reducing its viscosity and hence enables ease of pressing into a suitable propellant shape. It also improves the physical properties of the propellant by increasing its flexibility, making it easier to work with. In contrast, plasticisers used in HE compositions are employed to ensure flow of material into a fixed cavity and are used in very small quantities, less than 2% wt.

In compositions according to the present invention, component A provides the high energy capability of the composition. It may be desirable to replace a portion of the highly energetic filler with an IM energetic filler, in the range of from 10-40% wt.

Components B and C provides processability enabling mixtures to be formed together with component A which may be worked into a suitable dough-like material which may be pressed, rolled or extruded to form suitable propellant products. The mutual combination of these components is specially selected in compositions according to the present invention because of the unexpected advantages such a combination provides as follows.

Compositions according to the present invention can be suitably processed to provide propellant materials, eg for use as gun or rocket propellants, especially gun propellants, which unexpectedly and beneficially can show an improved, ie. reduced vulnerability over colloidal propellants, but without a corresponding decrease in energy normally associated with such an improvement.

The main properties which are desirable for a low vulnerability gun propellant, in addition to its reduced, vulnerability to shaped charge attack may be summarised as follows:

(1) a good practical propellant force; for example gun propellants for use in large calibre kinetic energy projectile applications or for use in artillery applications showing a force in the range of 820 KJ/kg to that of 1250 KJ per Kg or more.

(2) a low rate of burn desirably less than 80 mm per second; this allows stick propellants of reduced web size to be used;

(3) a low flame temperature desirably less than 3200K; this affords the possibility of reduced gun barrel erosion;

(4) the possibility of processing into a dough and extruding the dough using simple conventional processing solvents:

(5) the possibility of processing into a propellant product which shows little or no aeration with a density greater than 98%, preferably greater than 99 percent, of its theoretical maximum density; which results in a more dense and cohesive propellant matrix.

(6) low gas molecular weight, preferably in the range 20 to 22; enhancing the gas volume on ignition enhancing projectile velocity The propellant compositions embodying the invention are suitable for forming propellant products having unexpectedly all of aforementioned desirable properties.

The component A may be selected from high energy energetic filler, present in the range of 60% to 90% wt. Examples are heteroalicyclic nitramines, such as for example RDX(cyclo-1,3,5-trimethylene, 2,4,6-trinitramine, cyclonite or Hexagen), HMX (cyclo-1,3,5,7-tetramethylene-2,4,6,8-tetranitramine, Octogen) or TATND (tetranitro-tetraminodecalin) and mixtures thereof. Other high energetic fillers may be TAGN, aromatic nitramines such as tetryl, ethylene dinitramine, and nitrate esters such as nitroglycerine (glycerol trinitrate), butane triol trinitrate or pentaerythrital tetranitrate, and inorganic perchlorates and nitrates such as ammonium perchlorate optionally together with metallic fuel such as aluminium particles.

The IM energetic filler, may be selected from such as, for example, Nitrotriazolone (NTO), Hexanitrostilbene (HNS), Nitroguanidine (Picrite), Triaminotrinitrobenzene (TATB), Guarnylureadinitramide (FOX-12), 1,1-diamino 2,2-dinitro ethylene (FOX-7). The IM energetic filler is one which, without modification, has an FOI greater than 100. Many energetic fillers, including RDX and HMX may be modified, either via stabilisers or coatings such that they have a degree of IM compliance, and an FOI of greater than 100. The component A is selected from a material which is inherently IM, such as will have an FOI>100, without any processing or modification. It has been advantageously found that the inclusion of an IM energetic fill in the amount of from 5% to 25% by weight, provides a final composition which has a high level of IM compliance.

Component B, the binder may be selected from a non-energetic binder and/or an energetic binder, present in the range of from 8% to 16% wt. Preferably the binder is a mixture of an energetic and non-energetic binder; more preferably the energetic binder is present in the range of from 5%-10% by weight, non-energetic binder is present in the range of from 5%-15% by weight, with a binder % wt in the range of from 8%-16% wt.

Examples of suitable non-energetic binder materials which may be blended with EVA (ethylene-vinyl acetate) are cellulosic materials such as esters, ego cellulose acetate, cellulose acetate butyrate, polyurethanes, polyesters, polybutadienes, polyethylenes, polyvinyl acetate and blends and/or copolymers thereof.

Examples of suitable energetic binder materials which may be used along side a non energetic binder, such as EVA are nitrocellulose, polyvinyl nitrate, nitroethylene, nitroallyl acetate, nitroethyl acrylate, nitroethy methacrylate, trinitroethyl acrylate, dinitropropyl acrylate, C-nitropolystyrene and its derivatives, polyurethanes with aliphatic C- and N-nitro groups, polyesters made from dinitrocarboxylic acids and dinitrodiol and homopolymers of 3-nitrato-3 methyl oxetane (PolyNIMMO).

The composition comprises component C a plasticiser, wherein the plasticiser comprises a compound formula (A) of from 5% to 10% by weight.

Additional plasticisers which may be selected from a non-energetic plasticiser and/or an energetic plasticiser. Preferably the plasticiser is a mixture of energetic and non-energetic plasticisers; yet more preferably when both are present the;

energetic plasticiser is present in the range of from 0%-8% by weight, and non-energetic plasticiser, which includes formula (A), is present in the range of from 2%-10% by weight; such that the total plasticiser is preferably 5%-10% wt.

Examples of energetic plasticisers may be Butyl NENA, GAP (glycidyl azide polymer), BDNPA/F (bis-2,2-dinitropropylacetol/formal), dimethylmethylene dinitroamine, bis (2,2,2-trinitropropyl)formal, bis(2,2,2-trinitroethyl)formal, bis (2-fluoro-2,2-dinitroethyl)formal, diethylene gylcol dinitrate, glycerol trinitrate, glycol trinitrate, triethylene glycol dinitrate, tetrethylene glycol dinitrate, trimethylolethane trinitrate, butanetriol trinitrate, or 1,2,4-butanetriol trinitrate.

Examples of Formula (A) may be, Di Octyl adipate (DOA), Di Octyl Sebacate (DOS), dialkyl esters comprising sebacic adipic or maleic homologues, Further non-energtic non-phthalates binders may alos be present such as tricresyl phosphate, polyalkylene glycols and their alkyl ether derivatives, eg polyethylene glycol, polypropylene gycol, and diethylene glycol butyl ether.

Preferably, the plasticiser contains only a compound of formula (A), and preferably is present in the range of from 5%-10% wt.

Examples of minor additives may for example comprise one or more stabilisers, e.g. carbamite (N,N1-diphenyl, NN1-diethylurea) or PNMA (para-nitromethylmethoxyaniline); and/or one or more ballistic modifiers, e.g. carbon black or lead salts: and/or one or more flash suppressants, e.g. one or more sodium or potassium salts, e.g. sodium or potassium sulphate or bicarbonate and one or more binder-to-energetic filler coupling agents and one or more antioxidants.

According to a further aspect of the invention there is provided a gun propellant comprising sticks or granules comprising a composition according to any one of the preceding claims.

Compositions according to the present invention may be processed into propellants by techniques which are known to those skilled in the art. The ingredients are incorporated in a suitable kneader to form a homogeneous composition. Eventually, the composition produced is pressed, rolled or extruded in the form of a dough-like material through suitably shaped extrusion dies. Extrusion may be carried out using a co-rotating twin screw extrusion machine.

Sticks are usually formed by cutting to suitable length rods or strands extruded through suitable dies giving a shape including a longitudinal slot. Granules are usually similarly formed by cutting to much shorter lengths rods or sticks obtained by extrusion. Normally, such granules have small holes, ego seven holes running lengthwise therethrough to provide suitable burning surfaces.

Particularly preferred compositions are outlined in Table 1, below.

TABLE 1

IM propellant compositions

| Component | Ingredient | Comp 424 % wt | Comp 463 % wt | Comp 469 % wt |
|---|---|---|---|---|
| Component A | HMX | 74.5 | 74.5 | 74.5 |
| Component B | EVA | 7 | 7 | 7 |
| Component B | Nitrocellulose | 8.5 | 8.5 | 8.5 |
| Plasticiser | DBP | 9 | | |
| Formula (A) | DOA | | 9 | |
| Formula (A) | DOS | | | 9 |
| stabiliser | Carbamite | 1 | 1 | 1 |
| SCJ attack response Type | | III/IV | III/IV | III/IV |

Experimental

Several compositions in Table 1 were subjected to a test set-up in accordance with STANAG 4526, namely response to a shaped charge attack. The response was measured by taking into account the combined evidence from blast overpressure results, witness plate damage observed and from propellant debris observations.

Comp 424 is a known propellant composition which is prepared using a dibutyl phthalate plasticiser (DBP). Compounds 463 and 469 are phthalate free, and use DOA and DOS plasticisers, with no deleterious effect on the IM properties of the propellant composition. It has been unexpectedly found that phthalate plasticisers may be replaced by dialkyl diester plasticisers without compromising the IM properties of the propellant.

Whilst the invention has been described above, it extends to any inventive combination of the features set out above, or in the following description, drawings or claims.

Exemplary embodiments of the device in accordance with the invention will now be described with reference to the accompanying drawings in which:—

FIG. 1 shows a three-dimensional representation of a bundle of propellant sticks Turning to FIG. 1 there is provided an end portion of a bundle 1 of a plurality of propellant sticks 2. A resilient ligature 3 has been wound around the plurality of sticks 2 three times using a tying machine (not shown). The securing of the ligature 3 may be afforded by using a knot and subsequently cutting the ligature 3. Further ligatures may be applied to other distinct circumferences and in fact it may be preferred to have at least two ligatures applied at distinct circumferences in order to prevent the propellant sticks 2 from splaying.

The invention claimed is:

1. A propellant composition comprising the following components in the following relative proportions:

component A: from 55% to 75% by weight of a highly energetic filler comprising at least one nitramine compound, wherein component A further comprises Nitrotriazolone (NTO), Hexanitrostilbene (HNS), Nitroguanidine (Picrite), Triaminotrinitrobenzene (TATB), Guarnylureadinitramide (FOX-12) or 1,1-diamino 2,2-dinitro ethylene (FOX-7);

component B: from 5% to 15% by weight of a non-energetic binder selected from one or more ethylene-vinyl acetate compounds, and from 5% to 7% by weight of an energetic binder; and component C: from 8% to 10% of a plasticiser wherein the plasticiser contains only a compound of Formula (A), wherein Formula (A) is $R_1$—OC(O)—$R_3$—C(O)O—$R_2$, and $R_1$, $R_2$, and $R_3$ are independently selected from $C_1$ to $C_{10}$ alkyl or alkenyl, the percentages by weight of components A, B and C, together with minor additives, if any, adding to 100%.

2. The propellant composition of claim 1 wherein component A is one or more of RDX (cyclo-1,3,5-trimethylene, 2,4,6-trinitramine, cyclonite or Hexagen), HMX (cyclo-1,3,5,7-tetramethylene-2,4,6,8-tetranitramine or Octogen), TATND (tetranitro-tetraminodecalin), TAGN, aromatic nitramines, nitrate esters inorganic perchlorates and inorganic nitrates.

3. The propellant composition of claim 1, wherein the plasticiser is selected from di Octyl adipate (DOA) and Di Octyl Sebacate (DOS).

4. A gun propellant comprising sticks or granules comprising a composition according to claim 1.

5. The propellant composition of claim 1 wherein component A comprises a metallic fuel.

6. The propellant composition of claim 1 wherein $R_1$, $R_2$, and $R_3$ are independently selected from $C_3$ to $C_{10}$ alkyl or alkenyl.

7. The propellant composition of claim 1 wherein component A comprises an aromatic nitramine selected from tetryl and ethylene dinitramine.

8. The propellant composition of claim 1 wherein component A further comprises a nitrate ester selected from nitroglycerine (glycerol trinitrate), butane triol trinitrate and pentaerythrital tetranitrate.

9. The propellant composition of claim 1, wherein the plasticiser is selected from sebacic, adipic and maleic homologues of dialkyl esters.

10. The gun propellant of claim 4 exhibiting a propellant force in the range of 820 kJ/kg to 1250 kJ/kg.

11. The propellant composition of claim 5 wherein the metallic fuel comprises aluminum particles.

12. The propellant composition of claim 1 further comprising a stabilizer.

13. The propellant composition of claim 12 comprising a ballistic modifier and a flash suppressant.

14. The propellant composition of claim 3, wherein the plasticiser comprises Di Octyl Sebacate (DOS).

15. The propellant composition of claim 9, wherein the plasticiser comprises sebacic and maleic homologues of dialkyl esters.

16. An insensitive munition propellant composition consisting essentially of:

component A: from greater than 60% by weight of a highly energetic filler, the energetic filler comprising at least one nitramine compound and one or more of Nitrotriazolone (NTO), Hexanitrostilbene (HNS), Nitroguanidine (Picrite), Triaminotrinitrobenzene (TATB), Guarnylureadinitramide (FOX-12) and 1,1-diamino 2,2-dinitro ethylene (FOX-7);

component B: from 5% to 7% by weight of a non-energetic binder selected from one or more ethylene-vinyl acetate compounds, and from 8% to 10% by weight of an energetic binder; and component C: from 5% to 10% of a plasticiser, wherein the plasticiser consists of a compound having a formula of $R_1$—OC(O)—$R_3$—C(O)O—$R_2$, wherein $R_1$, $R_2$, and $R_3$ are independently selected from $C_1$ to $C_{10}$ alkyl or alkenyl groups, the percentages by weight of components A, B and C, together with minor additives, if any, adding to 100%.

* * * * *